United States Patent [19]

Fanelli et al.

[11] Patent Number: 4,646,213

[45] **Date of Patent: * Feb. 24, 1987**

[54] COLLAPSIBLE LANTERN

[76] Inventors: Michael W. Fanelli, 47 W. Ridgeway Rd., Dayton, Ohio 45459; Edward R. Masters, 321 Volusia Ave., Dayton, Ohio 45409

[ * ] Notice: The portion of the term of this patent subsequent to May 28, 2002 has been disclaimed.

[21] Appl. No.: 738,245

[22] Filed: May 24, 1985

Related U.S. Application Data

[63] Continuation-in-part of Ser. No. 619,580, Jun. 11, 1984, Pat. No. 4,520,431.

[51] Int. Cl.[4] ..... F21L 19/00

[52] U.S. Cl. ..... 362/180; 362/181; 362/363; 362/298; 362/450; 362/162; 431/298

[58] Field of Search ..... 362/180, 181, 182, 162, 362/363, 450, 298; 431/298

[56] References Cited

U.S. PATENT DOCUMENTS 1,318,614 10/1919 Skall ..... 362/162
3,296,439 1/1967 Barnhart et al. ..... 362/162 X
4,186,430 1/1980 Britton ..... 362/161
4,520,431 5/1985 Fanelli et al. ..... 362/162

*Primary Examiner*—E. Rollins Cross
*Attorney, Agent, or Firm*—Jacox & Meckstroth

[57] ABSTRACT

A cylindrical container of liquid fuel has a removable closure through which projects a tubular fitting supporting an adjustable wick. A set of spring metal support members are mounted on the container and have movable leg portions supporting a cylindrical transparent globe for axial movement between a collapsed position surrounding the container and an elevated position when the leg portions spring outwardly to form a stabilized support. A cover plate mounts on the globe and is retained by a cap member which engages the fitting and seals with the closure when the globe is in its collapsed position. A flexible chain connects the cap member to an L-shaped wire arm pivotally supported by one of the support members for movement between a collapsed position on top of the cover plate to an extended position where the chain may be used to suspend the lantern. The cover plate may be removed and replaced by a support ring having openings outboard of the globe to provide for heating a food container or the like.

18 Claims, 7 Drawing Figures

COLLAPSIBLE LANTERN

This application is a continuation-in-part of Ser. No. 06/619,580 filed 06/11/84 now U.S. Pat. No. 4,520,431.

BACKGROUND OF THE INVENTION

In the art of collapsible lanterns, for example, as disclosed in U.S. Pat. Nos. 147,204, 1,304,088 and 4,186,430, the light source may be a candle which is spring biased upwardly within a surrounding metal tube or casing, as disclosed in U.S. Pat. Nos. 147,204 and 4,186,430. The light source may also be a liquid fuel enclosed within a metal container and supplied through an adjustable wick, as disclosed in U.S. Pat. No. 1,304,088. A cylindrical glass tube is supported for vertical telescopic movement around the candle support tube in the lanterns disclosed in U.S. Pat. Nos. 147,204 and 4,186,430, and an oblong cover is supported for vertical telescopic movement relative to fixed transparent windows in the lantern disclosed in U.S. Pat. No. 1,304,088.

SUMMARY OF THE INVENTION

The present invention is directed to an improved collapsible lantern which incorporates a liquid fuel supply container and members mounted on the container for supporting a transparent globe for movement between an upper extended position and a lower collapsed position surround the container. The lantern of the invention further provides for distributing light completely around the lantern and for forming a sealed enclosure for the liquid fuel when the lantern is collapsed. In the extended position of the lantern, the support members provide outwardly projecting legs which stablize the support for the lantern, and the legs move inwardly when the lantern is collapsed and provide a protective support for the globe.

In accordance with one embodiment of the invention, the above features and advantages are provided by a lantern which includes a cylindrical liquid fuel container having a threaded cap supporting an externally threaded wick support tube surrounded by a resilient sealing ring. A set of support members are formed of spring steel strip and are mounted on the fuel container. The support members include inwardly collapsible leg portions which support a cylindrical transparent globe in either a retracted position surrounding the fuel container or an elevated position above the fuel container. A sheet metal cover is mounted on the globe and has a center opening for receiving a cap member which is threaded onto the wick support tube. The cap member retains the cover and engages the sealing ring when the globe is in its retracted position. A wire support arm is pivotally mounted on one of the support members and is connected to the cap member by a flexible chain which may also be used to suspend the lantern when the globe is extended. The cover may be removed and replaced by a support ring to provide for heating a food container.

Other features and advantages of the invention will be apparent from the following description, the accompanying drawing and the appended claims.

DESCRIPTION OF THE PREFERRED EMBODIMENT

Figure 1:
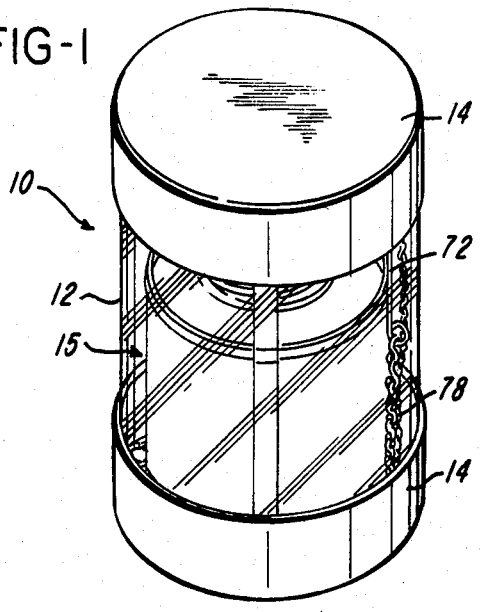
FIG. 1 is a perspective view of a storage and transport container enclosing a lantern constructed in accordance with the invention.
Figure 2:
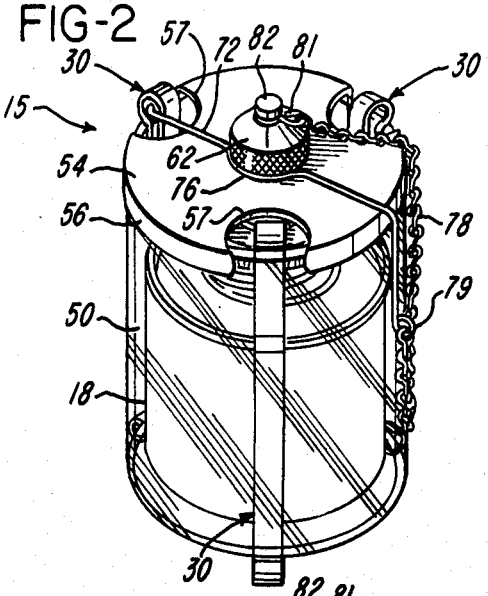
FIG. 2 is a perspective view of the lantern illustrated in its collapsed position.

FIG. 1 illustrates a generally cylindrical storage and transport container 10 which includes a cylindrical tube 12 of extruded transparent plastics material and two end caps 14 which are molded of a resilient plastics material. When the end caps 14 are pressed onto opposite end portions of the tube 14, the container 10 forms a substantially fluid-tight enclosure for a collapsible lantern 15 shown in FIG. 2.

As apparent from FIGS. 2–5, the lantern 15 includes a generally cylindrical metal can or container 18 for enclosing a supply of liquid fuel F such as a lamp oil. The container has a threaded tubular neck 19 which receives a threaded cap or closure 21 confining a sealing washer 22. The closure 21 has a center hole through which extends a tubular metal fitting 24 having external threads and rigidly secured to the closure 22 by a staking operation. The fitting 24 may also be secured by other means such as an adhesive or solder or by a nut threaded onto the fitting. A flexible cord-like wick 26 extends from the bottom of the container 18 upwardly through the tubular fitting 24 and may be adjusted vertically within the fitting.

A set of three support members 30 are uniformly spaced around the fuel container 18 and are formed from flat spring wire or strip. Each of the support members 30 includes a vertical mounting portion 32 and a bottom portion 34 which are connectd by a U-shaped portion 36. The bottom portions 34 of the support members 30 project inwardly under the bottom of the container 18 and are rigidly connected together by a center fastener or rivet 37. Each of the support members 30 also includes a shoulder portion 39 which projects inwardly over the upper rim of the metal container 18, and the shoulder portions 39 of the support members 30 cooperate with the bottom portions 34 to secure the assembly of the support members 30 to the container 18. Each of the support members 30 further includes an inverted U-shaped spring portion 42 which projects upwardly from the shoulder portion 39, and each of the spring portions 42 connects with a downwardly projecting leg portion 44 by an outwardly projecting shoulder portion 46. A hook-shaped foot portion 48 forms the bottom of each leg portion 44.

Figure 3:
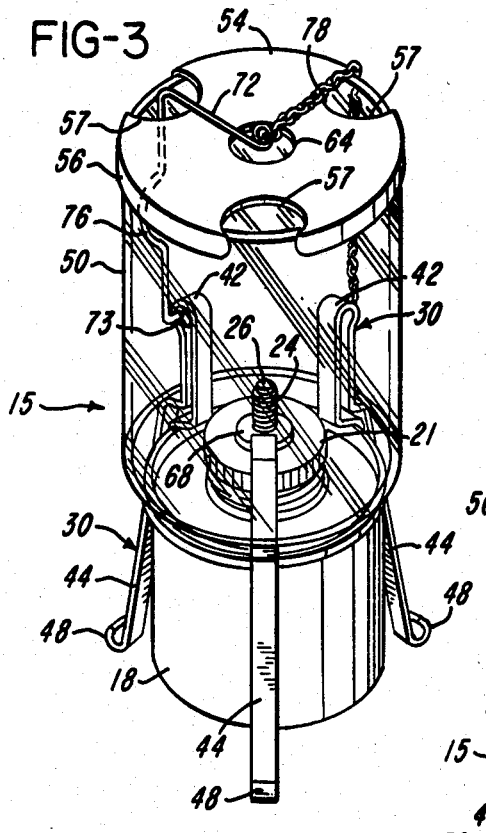
FIG. 3 is a perspective view of the lantern of FIG. 2 and shown in its extended position.
Figure 4:
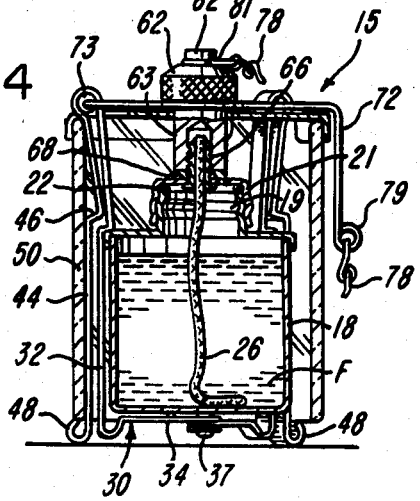
FIG. 4 is a vertical section of the collapsed lantern shown in FIG. 2.
Figure 5:
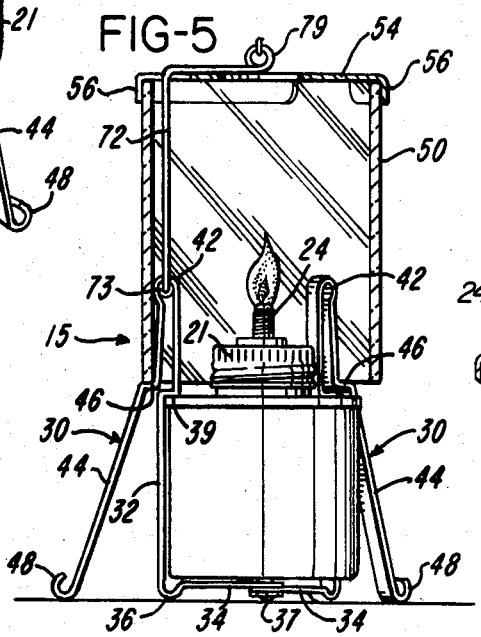
FIG. 5 is a part vertical section of the extended lantern shown in FIG. 3 and in operating condition.

A cylindrical transparent tube or globe 50, preferably formed of a Pyrex glass, is supported by the support members 30 in a lower retracted or collapsed position (FIGS. 2 and 4) and an upper elevated position (FIGS. 3 and 5). As shown in FIG. 4, when the globe 50 is in its lower collapsed position, it is confined between the feet portions 48 and the top of the spring portions 42 of the assembled support members 30. In the collapsed position of the globe 50, the leg portions 44 are retracted inwardly and engage the inner surface of the globe 50 to provide a protective support for the globe.

A sheet metal or stainless steel cover member or plate 54 is mounted on the upper end of the globe 50 and includes arcuate skirt portions 56 which depend adjacent the outer surface of the globe 50. The cover plate 54 also has three part circular recesses 57 which receive the upper end portions of the support members 30 when the globe 50 is in its collapsed position.

Figure 6:
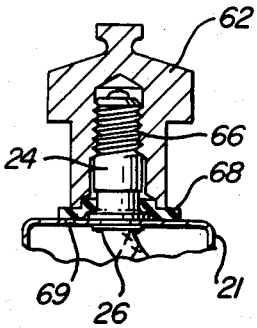
FIG. 6 is an enlarged fragmentary section of a portion of the lantern shown in FIG. 4.

A metal cap member 62 has a peripheral shoulder which engages the cover plate 54 and has a reduced cylindrical portion 63 which projects downwardly through a center hole 64 within the cover plate 54. The cylindrical portion 63 of the cap member 62 has a threaded hole 66 for receiving the tubular fitting 24, and a resilient washer 68 forms a fluid-tight seal between the cap member 62 and the closure 21 for the fuel container 18 when the cap member 62 is tightened. As shown in FIG. 6, the washer 68 covers a small air vent hole 69 within the closure 21, and the hole 69 is sealed by the washer 68 when the cap member 62 is tightened. When the cap member 62 is removed, the washer 68 moves upwardly to uncover the vent hole 69.

An L-shaped wire support member or arm 72 has one end portion pivotally connected to the upper end of a leg member 30 by a semi-resilient tubular plastic bushing 72. The wire support arm 72 has a curved portion 76 which extends around the cap member 62, and one end of a flexible chain 78 is connectd to a loop portion 79 forming the opposite or outer end of the support arm 72. The opposite end of the chain 78 is connected to a wire line 81 which is rotatably connected to a rivet-like tip portion 82 of the cap member 62.

When it is desired to use the lantern 15, it is removed from the container 10 by pulling off or removing one of the end caps 14. The cap member 62 is unthreaded from the wick support tube 24, and the wire support arm 72 is pivoted from its collapsed position (FIGS. 2 and 4) to an upright position (FIGS. 3 and 5). The globe 50 is then slid or moved upwardly on the support members 30 until the lower edge of the globe 50 clears the shoulder portions 46 of the support members 30. At this point, the leg portions 44 snap outwardly to support the globe 50 and to form a stabilized support for the lantern.

The fuel within the wick portion projecting above the support tube 24 may be ignited before the globe 50 is elevated and while the wick projects through the hole 64 within the cover plate 54. The wick may also be ignited by removing the cover member 54 form the globe 50 before the globe 50 is fully extended and elevated and then inserting a lighted match down into the globe. As apparent from FIGS. 3 and 5, when the globe 50 is fully elevated or extended, the wire support arm 72 is effective to retain the cover member 54 on the top of the globe 50. It is also apparent that when the globe 50 is extended, the wire support arm 72 permits the lantern to be suspended by the chain 78 at the top center of the lantern.

Figure 7:
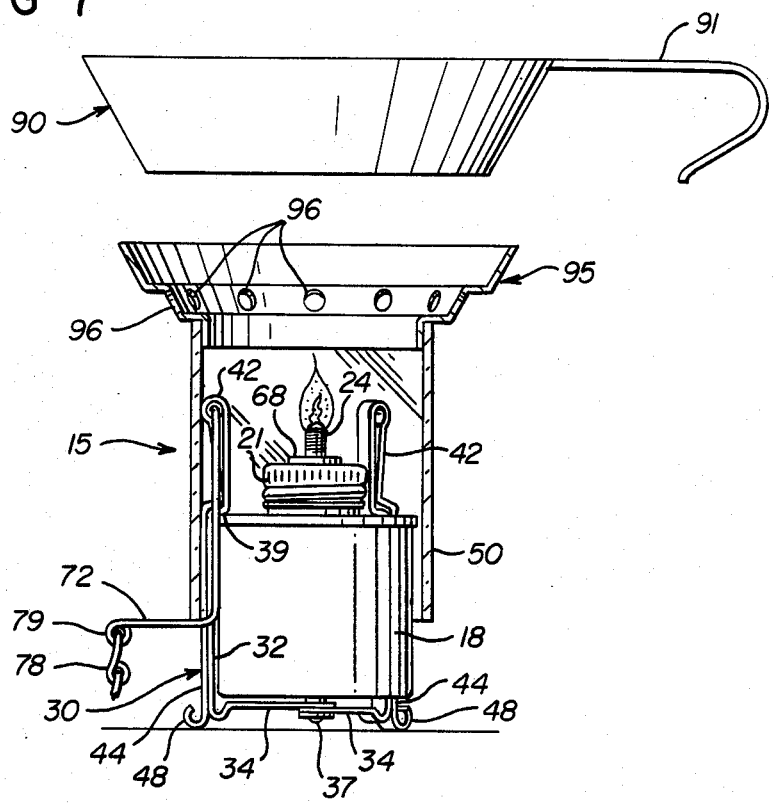
FIG. 7 is a view similar to FIG. 5 and showing the use of the lantern for heating a food container.

FIG. 7 illustrates the use of the lantern described above in connection with FIGS. 2–6 for heating or cooking a food product within a container or cup 90 shown in the form of a small sheet metal cooking pan having a finger grip handle 91. The lantern 15 is converted to perform the heating and/or cooking function by removing the top sheet metal cover 54 and sliding the globe 50 upwardly until it is removed from the metal support members 30. The wire support bail or element 72 is then pivoted downwardly to the position shown in FIG. 7, and the globe 50 is repositioned on the support members 30 until the bottom edge of the globe 50 rests on the wire support arm or element 72. In this position, the globe 50 is supported at an intermediate position between the lower collapsed position (FIG. 4) and the upper extended position (FIG. 5).

When the globe 50 is in the intermediate position shown in FIG. 7, an annular sheet metal support member or ring 95 is seated up on the upper end of the globe 50. The ring 95 has a series of circumferentially spaced vent holes or openings 96 which provide for exhausting the heated air flowing upwardly through the globe 50 and outwardly along the bottom of the container or pan 90 which is seated on the support ring 95. While the sheet metal container or pan 90 is shown in FIG. 7, it is apparent that other food containers may be supported by the ring 95, such as, for example, a soup can or coffee cup. Furthermore, while the wire support bail or element 72 limits the downward movement of the globe 50, the globe 50 may be shifted upwardly above the support element 72 in order to position the support ring 95 and the container 90 at a higher level above the flame produced by the wick 26 for less heating. In the higher position, the globe 50 is retained by the friction engagement of the support members 30 due to the outward pressure exerted by the leg portions 44 against the inner surface of the globe 50.

From the drawings and the above description, it is apparent that a collapsible lantern constructed in accordance with the present invention, provides desirable features and advantages. For example, the lantern 15 is simple in construction and operation. That is, the lantern may be quickly extended by removing the cap member 62 and elevating the globe 50 on the support members 30. The lantern may be quickly and conveniently collapsed simply by depressing inwardly on the leg portions 44 of the support members 30 and then lowering the globe 50.

When the cap member 62 is threaded onto the wick support fitting 24, the resilient washer 68 is compressed to form a fluid-tight seal which seals the air vent hole 69 and also prevents evaporation of the fuel from the wick 26 as well as seepage of fuel either through the wick or around the wick when the collapsed lantern is tilted or rotated during transport. The cap member 62 also secures or locks the lantern in its collapsed position, and the wire support arm or element 72 cooperates with the chain 78 to retain the cap member 62 as well as provide for suspending the lantern when desired. When the lantern is confined within the sealed enclosure provided by the container 10, the lantern is ideally suited for use by campers and backpackers. However, it is apparent that the lantern has many other uses. For example, the lantern 15 may be used with the perforated support ring 95 for heating or cooking a food product within a container such as the container 90.

While the form of lantern herein described constitutes a preferred embodiment of the invention, it is to be understood that the invention is not limited to this precise form of lantern, and that changes may be made therein without departing from the scope and spirit of the invention as defined in the appended claims.

The invention having thus been described, the following is claimed;

1. A collapsible lantern comprising a container adapted to receive a liquid fuel and having means defining a top opening, a removable closure covering the top opening, a wick element extending from within the container upwardly through the opening, the closure having means supporting the wick element, an annular transparent globe of sufficient size to surround the container, a plurality of peripherally spaced support members attached to the container and including means supporting the globe for movement between a lower collapsed position surrounding the container and an upper extended position surrounding the wick element.

2. A lantern as defined in claim 1 wherein each of the support members comprises a generally flat strip of spring metal, and means connecting the support members together below the container.

3. A lantern as defined in claim 1 wherein both the container and the globe are cylindrical.

4. A lantern as defined in claim 1 wherein each support member includes a generally vertical inner portion disposed adjacent the container, an inverted U-shaped upper spring portion, and a leg portion projecting downwardly from the spring portion and movable between a collapsed position adjacent the inner portion and an extended position sloping downwardly and outwardly from the spring portion.

5. A lantern as defined in claim 4 wherein the inner portion of each support member includes means for confining the container to restrict relative vertical movement beween each support member and the container.

6. A lantern as defined in claim 1 wherein each support member includes a generally horizontal bottom portion extending inwardly under the container, and means disposed below the container for connecting the bottom portions of the support members.

7. A lantern as defined in claim 1 wherein the fuel container comprises a cylindrical container, each of the support members comprises a metal strip, amd the globe comprises a cylindrical transparent body having an inner diameter slightly greater than the outer diameter of the container.

8. A lantern as defined in claim 7 wherein each of the support members comprises an L-shaped portion receiving the container, an inverted U-shaped spring portion projecting upwardly from the L-shaped portion, and a leg portion extending downwardly from the spring portion and movable between an outwardly projecting and sloping support position and a generally vertical retracted position adjacent the L-shaped portion.

9. A lantern as defined in claim 8 wherein the globe is confined between the spring portion and the leg portion of each support member when the globe is in its lower collapsed position.

10. A lantern as defined in claim 9 wherein the leg portion of each support member is connected to the corresponding spring portion by a shoulder portion disposed for supporting the globe in its upper extended position.

11. A lantern as defined in claim 1 wherein the means supporting the wick element comprise an externally threaded closure portion, and a cap member threadably connected to the closure portion and covering the wick element.

12. In a lantern adapted to be transported and including a container adapted to receive a liquid fuel and having means defining a top opening, a wick element extending from within the container upwardly through the opening, closure means for closing the opening and for supporting the wick element, a globe having a transparent wall, and support means attached to the container and supporting the globe in a position surrounding the wick element, the improvement wherein the closure means defines an air vent hole for the container, resilient sealing means positioned to engage the closure means, and a removable cap member for engaging the closure means and deforming the sealing means to form a fluid-tight seal for the wick element and the air vent hole.

13. A collapsible lantern comprising a container adapted to receive a liquid fuel and having means defining a top opening, a wick element extending from within the container upwardly through the opening, closure means for closing the top opening and for supporting the wick element, an annular transparent globe of sufficient size to surround the container, means mounted on the container and supporting the globe for movement between a lower collapsed position surrounding the container and an upper extended position surrounding the wick element, an annular support member mounted on the globe and having circumferentially spaced openings outboard of the globe, and the annular support member includes means for supporting a cup or pan for heating or cooking when the globe is above the collapsed position.

14. A lantern as defined in claim 13 and including a support element pivotally connected to the means supporting the globe, and the support element is positioned to support the globe when disposed between the collapsed and extended positions.

15. A lantern as defined in claim 14 wherein the support element comprises a generally L-shaped member.

16. A lantern as defined in claim 13 wherein the means supporting the globe comprise a plurality of support members, each support member including an inner portion disposed adjacent the container, an inverted U-shaped upper spring portion, and a corresponding leg portion projecting downwardly from the spring portion and moveable between a generally vertical collapsed position adjacent the inner portion and a supporting position sloping downwardly and outwardly from the upper spring portion.

17. A lantern as defined in claim 16 and including an L-shaped support element pivotally connected to one of the spring portions, the support element being pivotable between a collapsed position overlying the globe when the globe is in its collapsed position and an upwardly projecting supporting position when the globe is in its extended position, and the support element is movable to a third position supporting the globe in an intermediate position between the collapsed and extended positions.

18. A lantern as defined in claim 17 wherein the support element comprises a formed metal wire element.

* * * * *